US006765530B1

(12) United States Patent
Lalezari et al.

(10) Patent No.: US 6,765,530 B1
(45) Date of Patent: Jul. 20, 2004

(54) ARRAY ANTENNA HAVING PAIRS OF ANTENNA ELEMENTS

(75) Inventors: Farzin Lalezari, Boulder, CO (US); Brian Boone, Boulder, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 10/197,001

(22) Filed: Jul. 16, 2002

(51) Int. Cl.[7] ..... H01Q 3/22
(52) U.S. Cl. ..... 342/375
(58) Field of Search ..... 342/375, 374, 342/373

(56) References Cited

U.S. PATENT DOCUMENTS

| | | | | |
|---|---|---|---|---|
| 2,031,065 A | | 2/1936 | Posthumus et al. | 250/11 |
| 3,396,398 A | | 8/1968 | Dunlavy, Jr. | 343/814 |
| 3,680,142 A | | 7/1972 | Van Atta et al. | 343/770 |
| 4,480,255 A | | 10/1984 | Davidson | 343/844 |
| 4,933,682 A | | 6/1990 | Vaughan | 343/844 |
| 5,021,800 A | | 6/1991 | Rilling | 343/820 |
| 5,107,273 A | * | 4/1992 | Roberts | 342/417 |
| 5,274,391 A | | 12/1993 | Connolly | 343/820 |
| 5,909,196 A | | 6/1999 | O'Neill, Jr. | 343/895 |
| 6,008,775 A | | 12/1999 | Bobowicz et al. | 343/853 |
| 6,583,760 B2 | * | 6/2003 | Martek et al. | 342/373 |

* cited by examiner

*Primary Examiner*—Theodore M. Blum
(74) *Attorney, Agent, or Firm*—Sheridan Ross P.C.

(57) ABSTRACT

An antenna apparatus capable of generating scanning beams through a range of 0°–90° is provided. The antenna apparatus includes one or more rows of antenna elements, with the antenna elements in each row being arranged in pairs. The elements within a pair are separated by a distance of about lambda/four, and the pairs are separated by a distance of about lambda/two, where lambda is the wavelength of the center frequency of signals transmitted from the antenna apparatus. Transmit/receive circuitry may be electrically connected to each pair of antenna elements, with the signal to elements within a pair having a phase quadrature relationship so that the pair of antenna elements generates a scanning beam in one direction and a control pattern null is achieved in another direction. A control system controls the generation of a scanning beam output by the antenna apparatus.

48 Claims, 11 Drawing Sheets

ARRAY ANTENNA HAVING PAIRS OF ANTENNA ELEMENTS

FIELD OF THE INVENTION

The present invention relates to an antenna apparatus and, in particular, a small antenna array that generates an endfire pattern in a desired direction while simultaneously forming a null in the opposite direction. Employing the particular antenna apparatus in a larger antenna array of many elements provides a wide field of view by increasing the scanning ability of the array element to near grazing angles.

BACKGROUND OF THE INVENTION

Antenna array systems for transmitting and/or receiving data or other information have been devised in a variety of configurations. Phased array antenna systems require many costly components that contribute to a design complexity that may not be acceptable or appropriate for certain situations. The most general implementation of a phased array produces an array design capable of focusing the energy from all antenna elements to any desired point in space. Phased array antennas have their elements arranged in rectangular or triangular grid lattices and are capable of focusing the antenna array pattern from broadside to the array to angles nearing 50 degrees off of broadside without difficulty. Scanning the array to angles exceeding 50 degrees becomes increasingly more difficult. In some applications, however, it may be desirable to operate an array in an endfire mode, which directs the radiation along the axis of the array at a scan angle of 0°, corresponding to 90° from broadside.

Endfire operation is the most difficult mode in which to use a phased array. Upon attempting to use a phased array to scan in the endfire direction, several problems arise which severely limit the array's ability to scan to angles approaching endfire. Traditional designs used for antenna arrays which are required to scan in the endfire direction call for very specialized antenna elements with limited fields-of-view (FOV). If an application requires an antenna array which is able to scan beyond the maximum scan angle of the antenna element, multiple arrays must be used. For example, if an application required 0°–90° of scan angle, three arrays might be needed, one for scan angles of 0°–15°, another for scan angles of 15°–30°, and a third for scan angles beyond 30°. While the use of multiple arrays can increase the scan angle of the antenna system, it can increase the cost and complexity of the antenna system.

In addition to the scan angle limitations, traditional endfire antennas have other physical problems. For example, grating lobes will be generated if the inter-element spacing exceeds $\lambda_0/2$ and the array is used to scan to angles exceeding a nominal value. This includes scanning the array to angles approaching endfire. A grating lobe is a lobe other than the main lobe produced by an antenna array when the inter-element spacing is sufficiently large to permit the in-phase addition of radiated fields in more than one direction. Grating lobes are undesirable because the antenna is less efficient due to the energy that is being directed in the direction of the grating lobe instead of in the desired direction of the main beam of the antenna pattern. Additionally, grating lobes result in possible target ambiguities and false targets which arc difficult for a radar to resolve. In order to reduce grating lobes produced by the application of an antenna for endfire applications, elements in an array are typically arranged such that the distance between the elements is less than one-half wavelength of the center operating frequency of the array (i.e. $\lambda_0$.) However, this element spacing constraint can increase the difficulty and cost to manufacture the array and increase the mutual coupling between elements causing increased mismatch with scan angle. Phased array antennas typically have certain components which are required for each element within the array. This hardware includes transmit and receive modules (T/R modules), phase shifters, low noise amplifiers, high power amplifiers, and limiters. If the elements are spaced relatively closely, as discussed above, this results in an antenna which is difficult and expensive to build, expensive to maintain, and may have reliability issues.

In addition to the cost and complexity of phased array antennas designed for use in endfire applications, the antenna systems ability to transmit and receive can also be degraded. As described above, scan limitations are common for phased array antennas scanning in an endfire mode. Scan limitations result from mutual coupling between elements in an array. Mutual coupling is the mechanism by which fields present at one element due to a forced excitation produce significant fields in other elements. Due to mutual coupling, a fraction of the energy incident on each element in the array will be scattered off the elements in all directions, allowing the elements themselves to behave as secondary radiators. Mutual coupling results in an active impedance which is a function of scan angle. If the active impedance of the elements in an array is not controlled by some means, large reflection coefficients will result and the individual elements will reflect power that is incident on them from the transmitter. In other words, the antenna will not transmit the power input into the phased array antenna. The reflection coefficient is the ratio of reflected to forward voltage at a specified reference plane. In traditional array antennas as the scan angle approaches endfire, the active impedance causes the reflection coefficient to increase towards a value of one. As the reflection coefficient approaches a value of one, only a very small percentage of the power input into the array is transmitted, while the remaining power is reflected back to the transmitter. Additionally, the reflected power creates heating within the antenna, which must be dissipated.

When scanning an array antenna, it is desired to have the magnitude of the reflection coefficient as small as possible. In many applications, an acceptable magnitude of the reflection coefficient is approximately 0.33, which results in a voltage standing wave ratio (VSWR) of 2:1. For an application with a FOV extending from 0° to 90° (where 90° corresponds to the plane of the array), the VSWR must be below 2:1 for satisfactory performance. Another way to consider the detrimental effects of excessive reflection coefficient is to consider the effective transmission loss due to reflection coefficient. An effective transmission loss can be computed for any value of reflection coefficient. Transmission loss is a measure of output power compared to input power and can be measured in dB by taking $10 \log_{10}(x)$ where x is the ratio of output power over input power.

The net result of the uncontrolled active impedance of N elements in an array antenna is to produce an excessive VSWR or excessive transmission loss at specific angles over the FOV the antenna will be used to scan through, as well as a trend of severely degraded performance over angles nearing endfire. The occurrence of high VSWR at specific angles is referred to as scan blindness. Traditionally the effects of scan blindness have been dealt with by mitigating the effects of high VSWR by designing the array with a lattice structure favoring performance over some regions while compromising performance over other regions. Although design measures can be taken to mitigate scan blindness effects and the effects of severely degraded performance as an array is scanned near endfire, technology has not been available to altogether eliminate or reduce these effects to a satisfactory level.

In addition to active impedance performance of an array another very important characteristic of the array is the reduced radar cross section (RCS). Reduced RCS is directly attributed to the reduction in impedance mismatch or reflection coefficient as an array antenna is scanned throughout its FOV.

SUMMARY OF THE INVENTION

In accordance with the present invention, an apparatus is disclosed for providing an array antenna capable of scanning zero through ninety degrees. The apparatus includes one or more rows of antenna elements. Each row of antenna elements is arranged such that the antenna elements are in pairs, with a first pair having a first and a second antenna element and a second pair having a third and fourth antenna element. It is important that antenna element pairs be isolated from each other (no, or substantially no, interference or other effect by one pair of antenna elements on another pair of antenna elements during energization or other use thereof) not that one antenna element of a pair be isolated from the other antenna element of the pair. Each antenna element of the same pair is also excited with a single feed point. An antenna element may be comprised of one or more parts, components or sub-clement, all of which are required to achieve proper functioning of the antenna elements. For example, one dipole which has more than one integral part is one antenna element, not two antenna elements. In one embodiment, the antenna elements have a longitudinal center axis, and the antenna elements are laterally spaced from each other in a direction substantially perpendicular to the longitudinal center axes. A first lateral distance is defined between the longitudinal center axes of the first and second antenna elements and a second lateral distance is defined between the longitudinal center axes of the second and third antenna elements, with the second lateral distance being greater than the first lateral distance. The apparatus may have transmit and/or receive (T/R) module circuitry electrically connected to each pair of antenna elements that transmits and receives signals. In this case the apparatus would have a control system that controls activation and deactivation of the transmit and/or receive module circuitry, with the control system controlling generation of a scanning beam output by the antenna apparatus. The apparatus may also be used in a simpler array architecture not requiring transmit and/or receive circuitry at each pair, but instead with multiple element pairs combined with a passive beamforming network.

A first halfway point is defined between the longitudinal center axes of the first and second elements and a second halfway point is defined between the longitudinal center axes of the third and fourth antenna elements. A pair separation distance is defined between the first and second halfway points. Lambda ($\lambda_0$) is defined as the wavelength of the center frequency of signals transmitted by the array antenna.

In one embodiment, the pair separation distance is greater than $\lambda_0$/two, and the lateral distance between the first and second elements within a pair equals about $\lambda_0$/four. The first and second antenna elements within a pair are arranged to be 90° out of phase with one another and have a phase quadrature relationship so that the pair of antenna elements generates a scanning beam in a first direction and a controlled pattern null in a desired direction. Each pair of antenna elements may be a different type of element radiator such as a pair of slot antenna elements, a pair of micro-strip patch antenna elements, a pair of monopole antenna elements or a pair of dipole antenna elements.

In one embodiment, the first and second antenna elements are slot antenna elements and are formed in a body member, and are coupled together using a coupling structure. The T/R module circuitry includes a T/R module operably connected to the coupling structure. The coupling structure has a midpoint, and the first T/R module is connected to the coupling structure offset from the midpoint, resulting in an offset signal between the two antenna elements. The difference in length of the coupling structure between elements is $\lambda_0$/four, resulting in the signal offset at the antenna elements being 90°.

Based on the foregoing, several benefits of the present invention are readily seen. The antenna apparatus can generate a scanning beam which is movable between at least 0°–90°, where 0° is defined along a plane parallel to the first row of antenna elements and 90° is defined along a plane perpendicular to the first row of antenna elements. While scanning through 0°–90°, the magnitude of the reflection coefficient produced by the scanning beam is desirably low. Additionally, the transmission loss of the scanning beam is reduced.

Additional advantages of the present invention will become readily apparent from the following discussion, particularly when taken together with the accompanying drawings.

DETAILED DESCRIPTION

Figure 1:
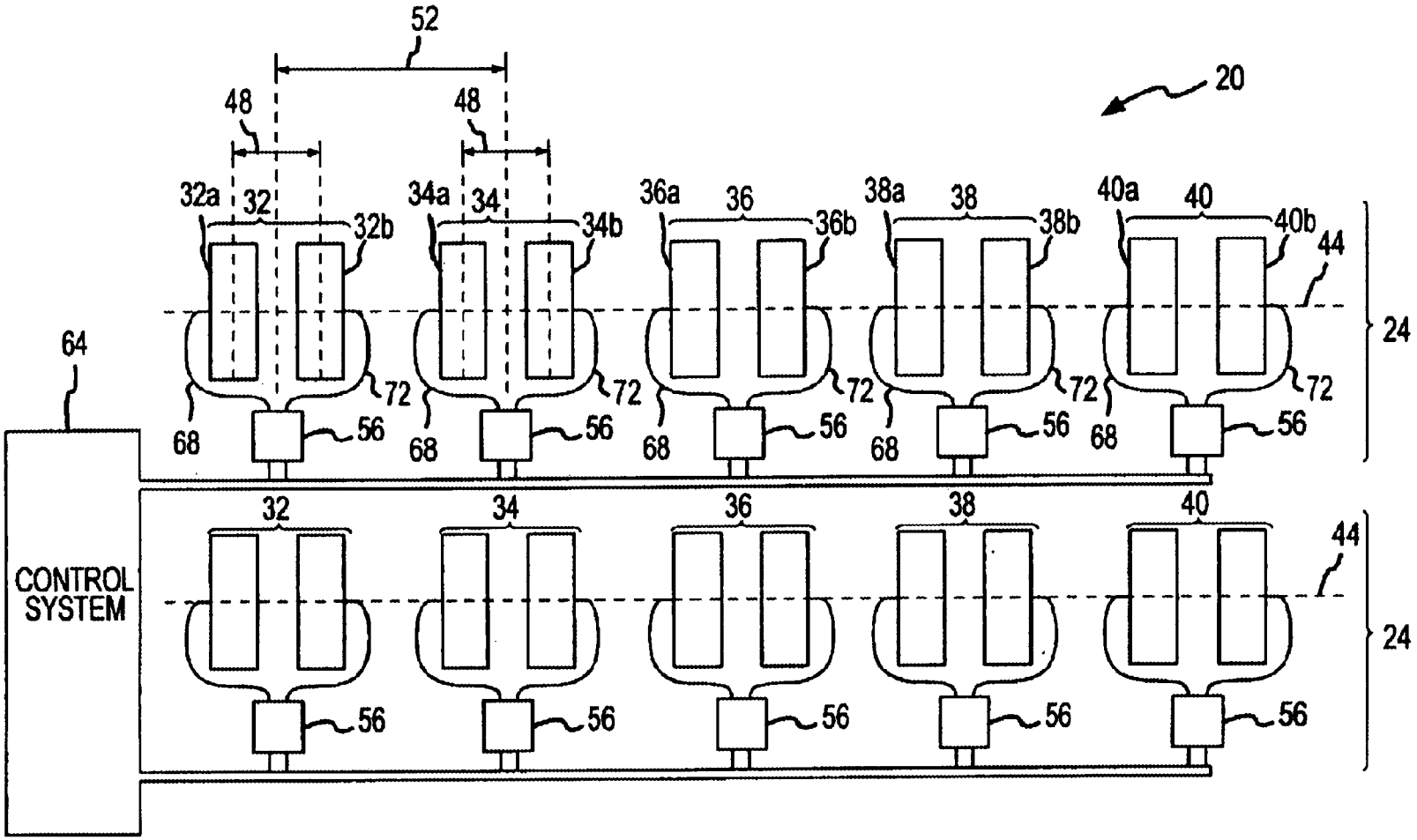
FIG. 1 schematically illustrates an antenna apparatus of the present invention.

With reference to FIG. 1, a portion of the array antenna 20 of the present invention is shown. The array antenna 20 contains two rows 24 of antenna elements. Each row 24 of elements contains five pairs 32, 34, 36, 38, 40 of antenna elements. It should be understood that this configuration is shown for the purpose of example and discussion only, and that the antenna 20 may contain more or fewer rows of elements, and more or fewer pairs of elements in each row. Furthermore, the rows 24 within the antenna array 20 may be aligned relative to each other to form a near rectangular lattice, or may be offset relative to each other in a staggered arrangement which may create a near triangular lattice. For purposes of discussion, the first two pairs 32, 34 of antenna elements in one row will be used to describe the antenna, with the understanding that the remaining pairs of elements in each row have the same structure. The pairs 32, 34 each contain two individual antenna elements 32*a*, 32*b*, 34*a*, 34*b*. The pairs 32, 34 of antenna elements have a longitudinal center axis 44. The antenna elements 32*a*, 32*b* within the first pair 32 are arranged such that adjacent elements 32*a*, 32*b* within the pair 32 are laterally spaced from one another with a first lateral distance 48, which is the distance between elements 32*a*, 32*b* within the pair 32. The second pair 34 likewise has this same first lateral distance 48 between the adjacent antenna elements 34*a*, 34*b* within the second pair 34. A second lateral distance 52 which is the distance between a halfway point between elements 32*a* and 32*b* and a halfway point between elements 34*a* and 34*b*.

Figure 2:
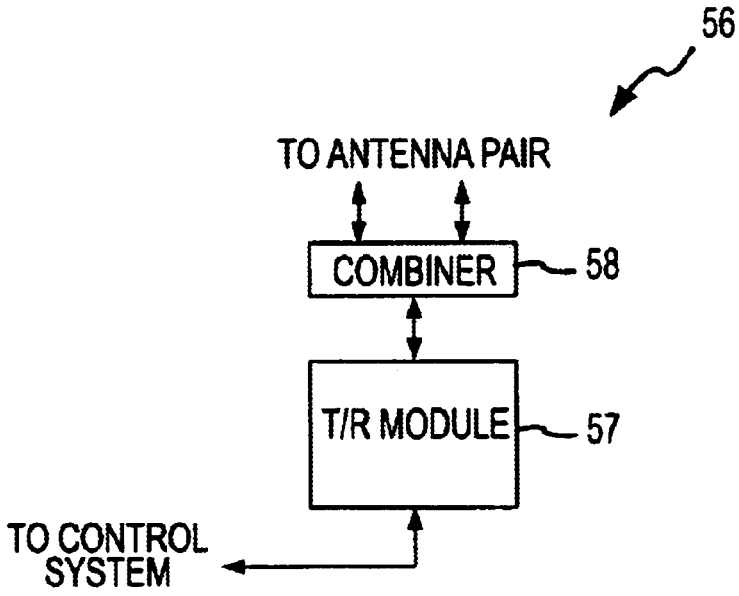
FIG. 2 is a block diagram illustration of an interface for a pair of antenna elements for one embodiment of the present invention.
Figure 3:
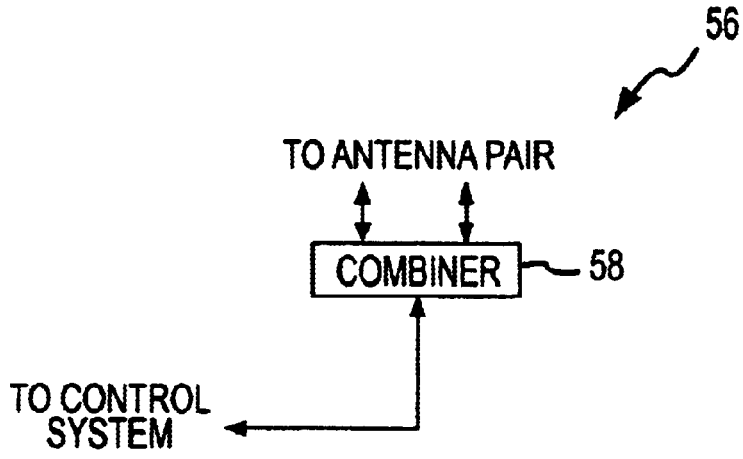
FIG. 3 is a block diagram illustration of an interface for a pair of antenna elements for another embodiment of the present invention.

Each pair 32, 34 of antenna elements is connected to an interface 56 which is connected to a control system 64 which controls the transmission and reception of the antenna 20. The interface 56, in one embodiment as illustrated in FIG. 2, includes a transmit and/or receive (T/R) module 57, and a combiner 58. The T/R module 57 can include an amplifier and phase shifter which are controlled by the control system 64. In another embodiment, illustrated in FIG. 3, the interface 56 is simply a combiner 58. In this embodiment, the control system 64 would include a passive beamforming network.

Referring again to FIG. 1, the antenna elements 32*a*, 32*b* within the first pair 32 are arranged such that the first lateral distance 48 between the elements 32*a*, 32*b* is one-quarter lambda ($\lambda_0$), where $\lambda_0$ is the wavelength in free space of the center frequency signals transmitted or received from the antenna 20. The pairs 32, 34 of antenna elements are separated by the second lateral distance 52 which is preferably $\frac{1}{2}\lambda_0$. The elements 32*a*, 32*b* within a pair 32 have feeds 68, 72 which, in one embodiment, are connected to the elements 32*a*, 32*b* such that the radiation in a desired direction from the two elements is 180° out of phase, while in a second desired direction the radiated fields from the two elements is in phase. This configuration results in a decreased level of mutual coupling between adjacent pairs 32 and 34.

When a signal is transmitted from the antenna 20, the two elements 32*a* and 23*b* in each pair 32 are excited in quadrature. This is accomplished by employing a ninety degree offset combiner 58 to excite the two elements in pair. The combiner 58 acts to delay the signal for one feed while allowing the signal to the other feed to pass directly through. The combiner 56 may be optimized for active impedance of the pair over full array scan angles, or may be optimized for active impedance over the scan region of 0°–90° and the optimized phase is 90°. The combiner 58 may also be optimized for active impedance over the scan region, where the scan region can be switched from 0°–90° to 90°–180° by switching the delay present in the combiner 58 from 90° to −90°. Furthermore, the combiner 58 may also be optimized for active impedance, and be variable dependent upon the array scan angle. In one embodiment, a beamforming network is used to combine the pairs of antenna elements and produce beams in any desired direction. In one embodiment, illustrated in FIG. 4, slot antenna elements are employed. The appropriate delay is achieved by using a coupling structure 80 which couples two slot elements 84, 88. The first slot element 84 feeds from the feed end of the coupling structure 80, while the second slot element 88 feeds from the other end of the coupling structure 80. The difference in length of the coupling structure 80 to each element produces a one-quarter wavelength delay between the signal of the first slot element 84 and the second slot element 88. The coupling structure 80 has a midpoint 82 which is located between the two slot elements 84, 88.

Figure 4:
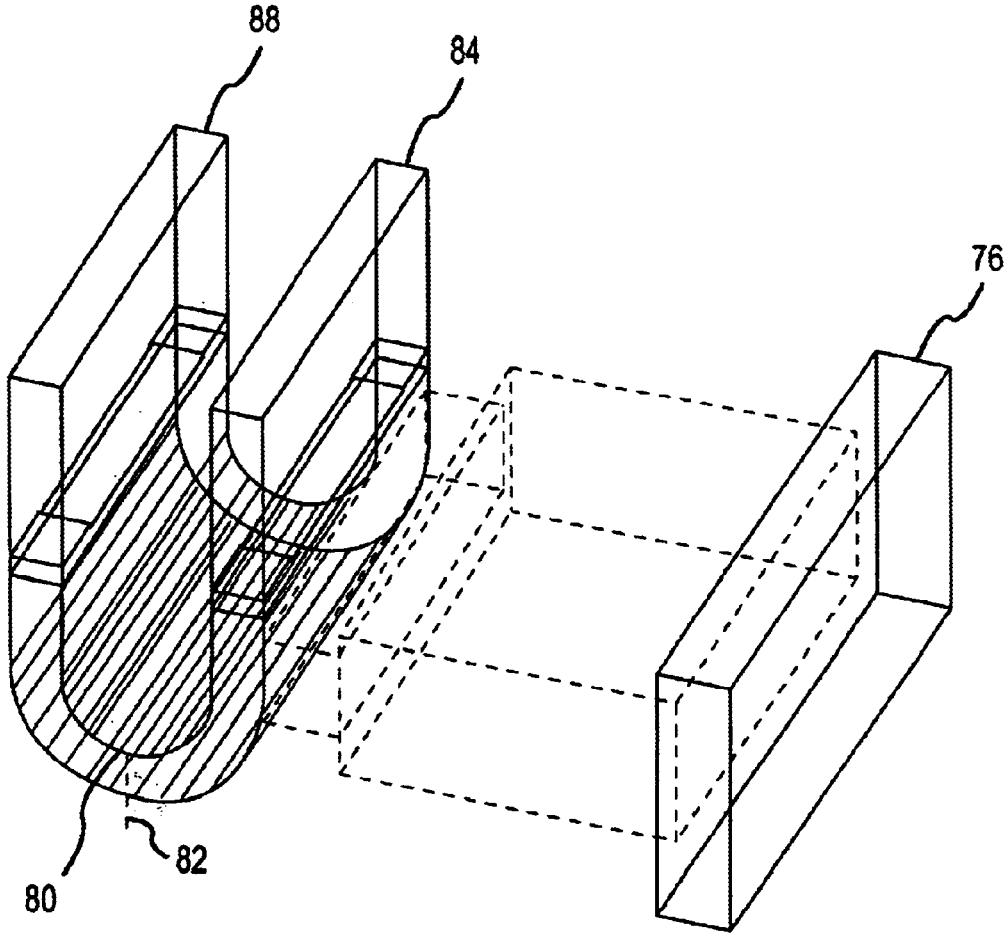
FIG. 4 is a perspective view of a pair of antenna elements and their associated coupling structure.
Figure 5:
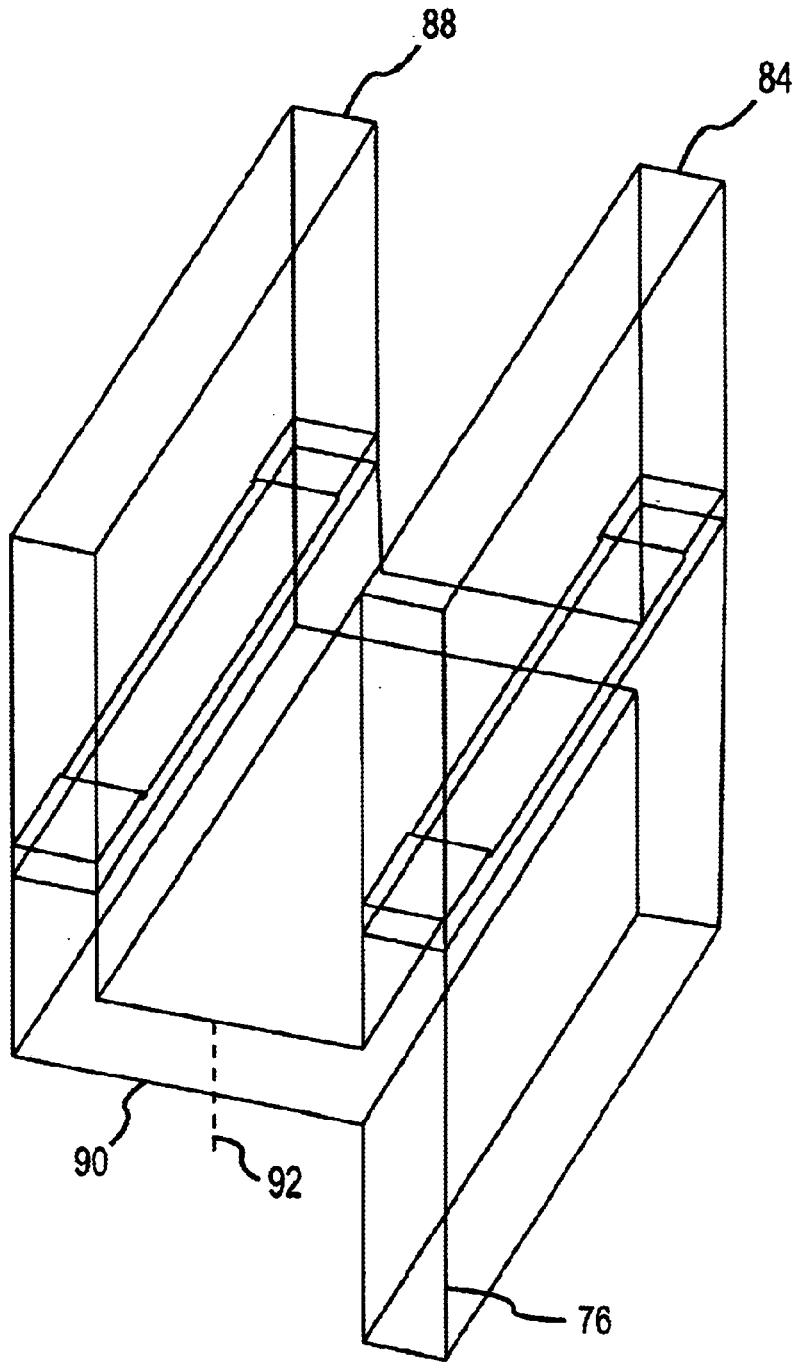
FIG. 5 is a perspective view of a second embodiment of a pair of antenna elements and their associated coupling structure.
Figure 6:
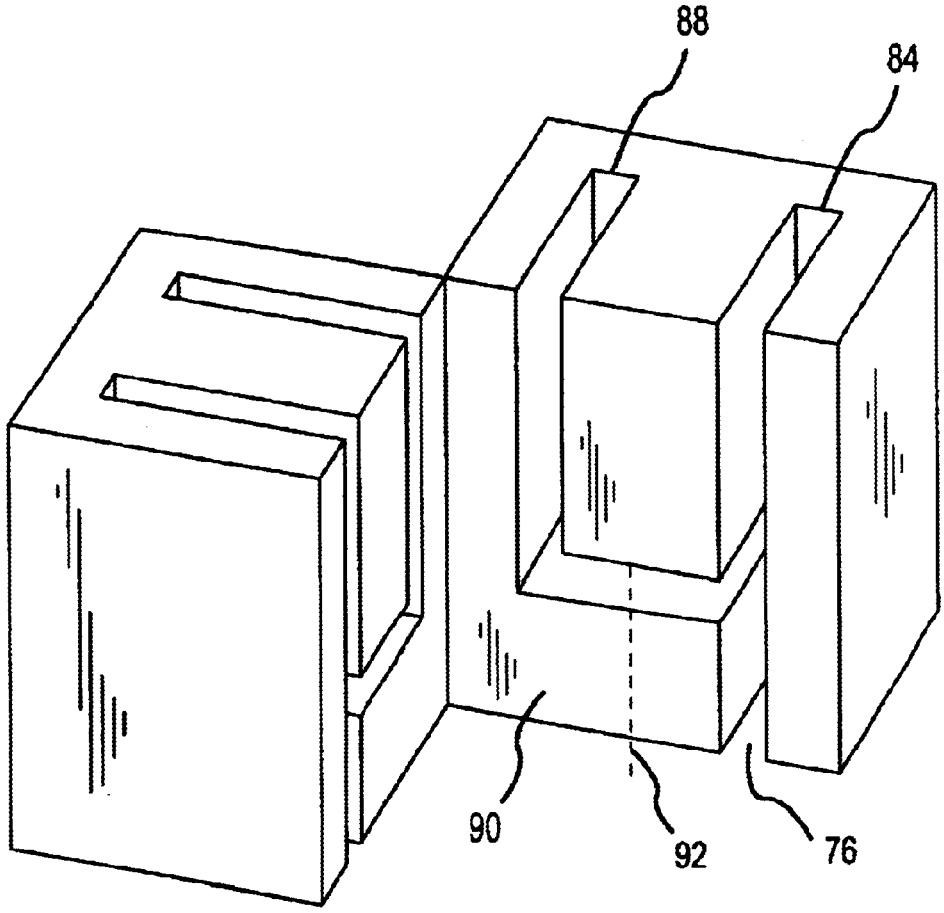
FIG. 6 is a perspective view, partially in cross-section, of the second embodiment of a pair of antenna elements and their associated coupling structure.

FIG. 4 shows a U shaped coupling structure 80, however, other shaped coupling structures may be used as shown in FIG. 5, which shows a square shaped coupling structure 90, with a midpoint 92. As can be seen in FIGS. 4 and 5, the feed 76 into the coupling structure 80 may be from the side, as illustrated in FIG. 4, or the feed 76 into the coupling structure 90 may be from the bottom as illustrated in FIG. 5. The direction the feed 76 comes from is not critical, as long as it is located away from the midpoint 82, 92 of the coupling structure 80, 90 such that the delay 6f the signal reaching the second slot element 88 results in a signal offset between the elements of approximately $\frac{1}{4}\lambda_0$. Furthermore, the feed signal may be inverted, thus switching the delay from +90° to −90°. When the delay is +90°, the scan region for the array antenna is 0°–90°, and when the delay is −90°, the scan region is 90°–180°. Note, the coupling structure can be accomplished with other transmission line techniques including microstrip, stripline, or suspended stripline. Although a slot antenna configuration is shown, it will be understood that the antenna may also be composed on other types of antenna elements, such as microstrip patch elements, monopole elements and dipole elements, with appropriate delay apparatus between the elements in a pair. FIG. 6 shows one embodiment of the square shaped coupling structure 90 in which the antenna elements 84, 88, and coupling structure 90 are formed in a body member.

The antenna elements in the array antenna may be manufactured using a number of techniques, depending upon the type of antenna element being employed. For example, the antenna elements may be manufactured using machining techniques. The array antenna may also be manufactured, for example, using casting, investment casting, electroforming, or injection molding techniques.

Figure 7:
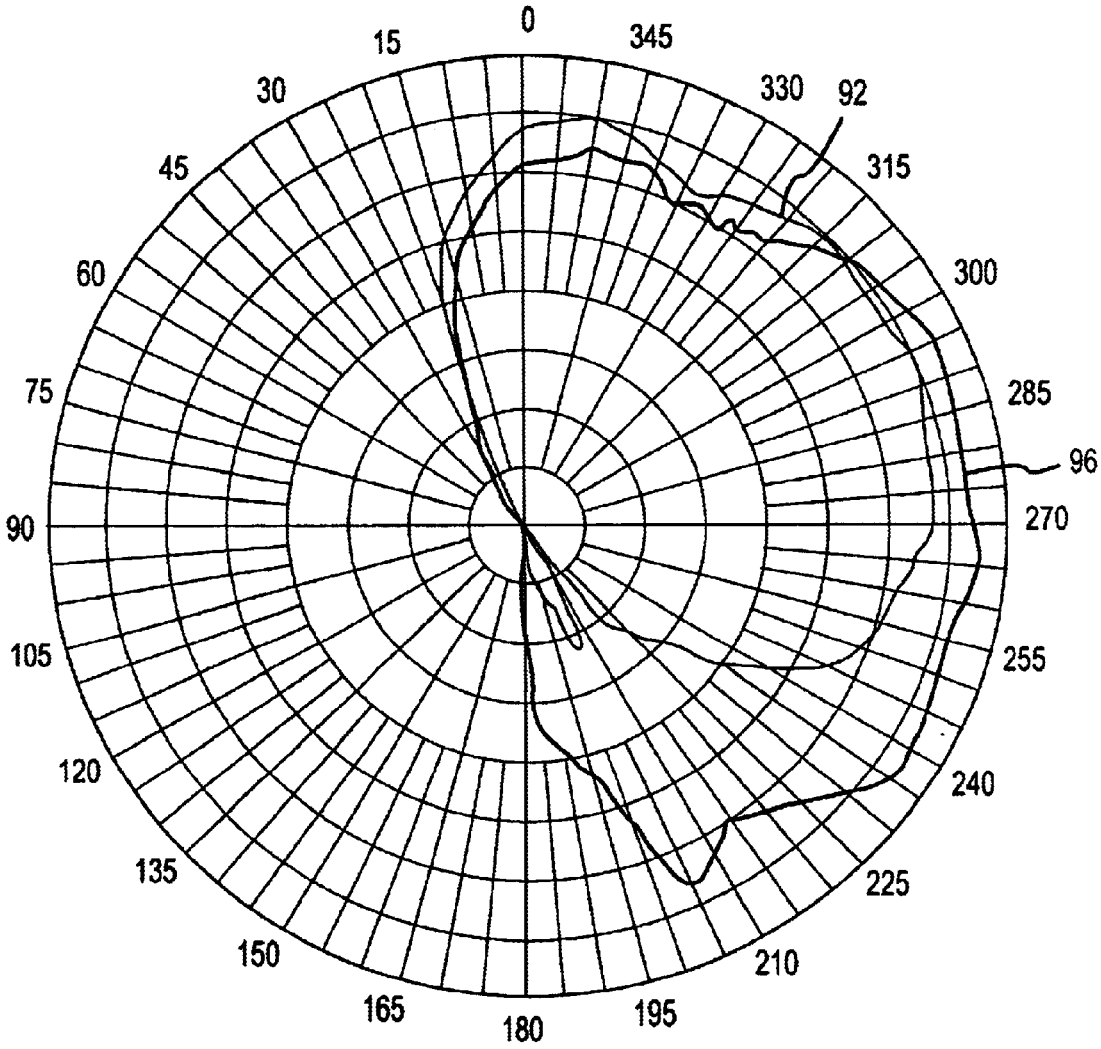
FIG. 7 is a graph illustrating a beam pattern from a dual slot antenna compared to a beam pattern from a single slot antenna.

When the antenna 20 is operated in the above described configuration, it has the effect of forming a beam in one direction, and a null in another direction. With reference now to FIG. 7, a beam pattern for a dual slot antenna is compared to the beam pattern for a prior art single slot antenna. As can be seen by the solid line 92, the dual slot configuration results in a scanned beam capable of scanning substantially from zero degrees through ninety degrees, while maintaining a null in the remaining directions. The dashed line 96 in FIG. 7 shows a beam pattern for a single waveguide slot antenna, where the scanned beam covers substantially beyond the zero through ninety degree scan angles. As can also be seen by comparing the solid line 92 and dashed line 96, the gain of the dual slot configuration at endfire (i.e. 0°) is about 3 dB greater than the gain for a single waveguide slot antenna at endfire. Accordingly, such a dual slot antenna would require only about one-half of the power to scan at endfire than a single slot antenna.

Figure 8A:
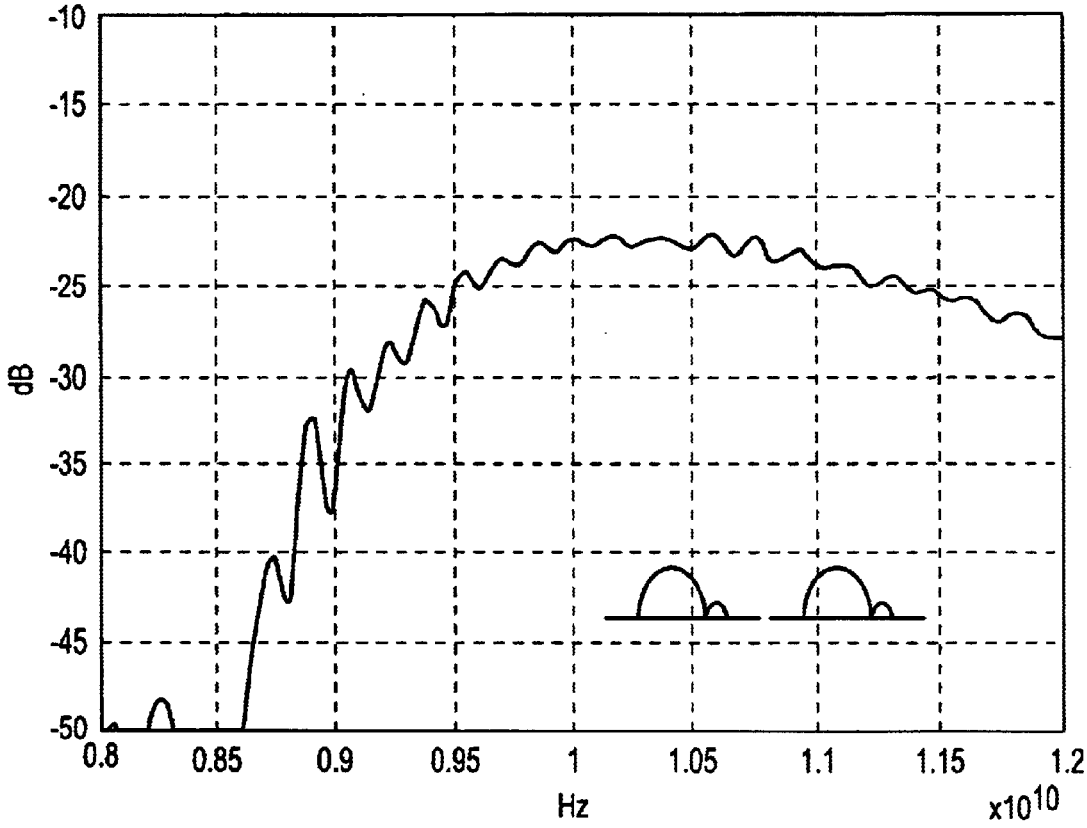
FIG. 8A is a graph illustrating coupling levels between elements 38 and 40 of an antenna apparatus of the present invention.
Figure 8B:
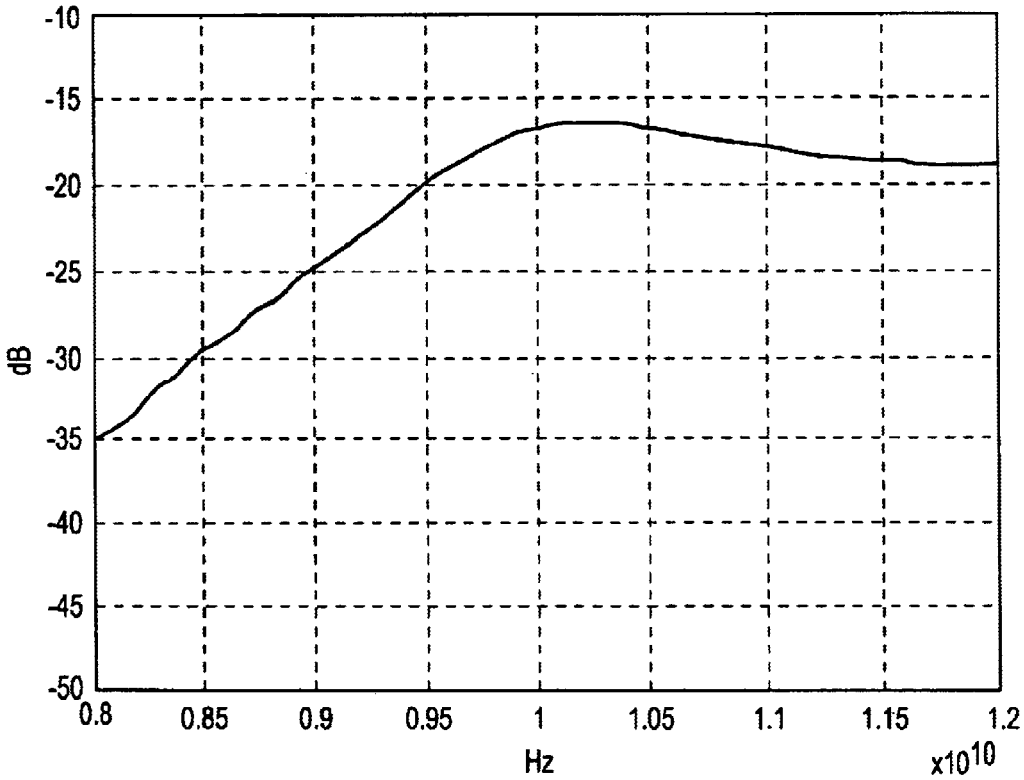
(PRIOR ART) FIG.8B
FIG. 8B is a graph illustrating coupling levels between elements of a prior art antenna apparatus.

With reference now to FIGS. 8A and 8B, the coupling between elements in the antenna 20 are described. FIG. 8A shows the coupling levels between elements 38 and 40. As the figures show, reduced coupling exists between elements of the antenna 20 as compared to a prior art basic single slot antenna, as shown in FIG. 8B. This reduced coupling between elements results in a higher level of isolation between elements as compared to a basic single slot antenna, and is due to the null in the aft direction of the pair of elements.

Figure 9:
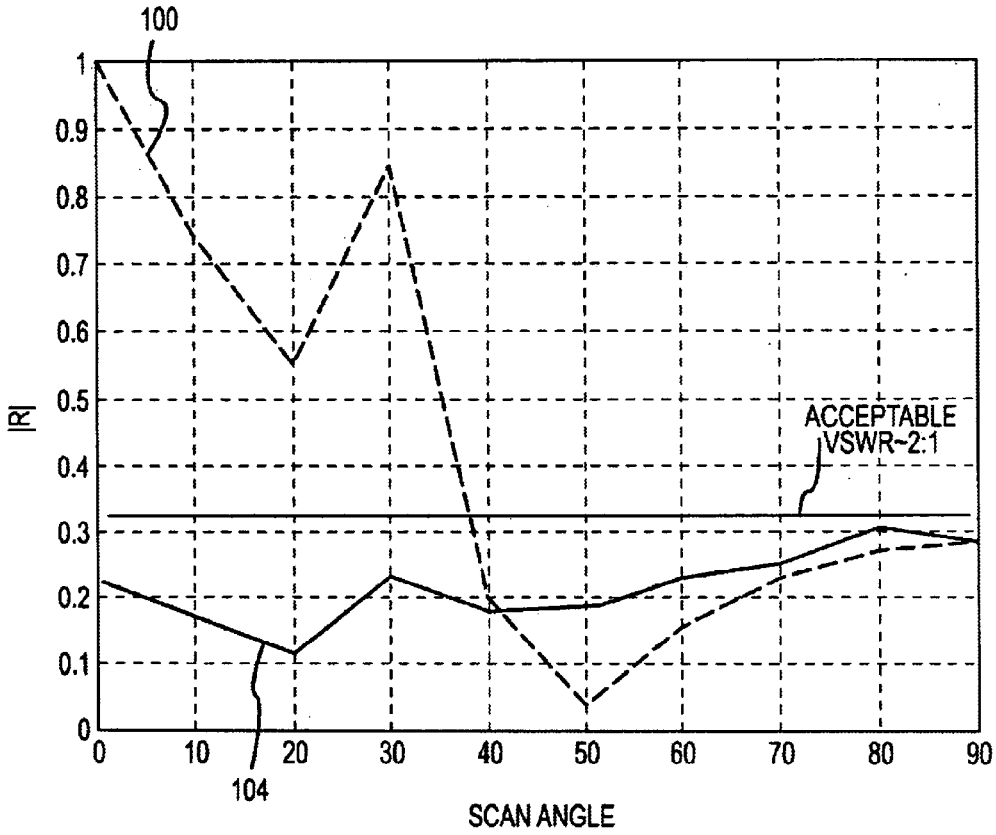
FIG. 9 is a graph illustrating the magnitude of the reflection coefficient for scan angles of 0°–90° from a dual slot antenna compared to a single slot antenna.

FIG. 9 shows the magnitude of the reflection coefficient for a single slot antenna and a dual slot antenna. The reflection coefficient is a complex quantity which is the ratio of the voltage into the antenna to the voltage reflected from the antenna The magnitude of the reflection coefficient as shown in FIG. 9 is the magnitude of the complex number. The magnitude of the reflection coefficient for a single slot antenna is shown in a dashed line 100, and the magnitude of the reflection coefficient for a dual slot antenna is shown in the solid line 104. As FIG. 9 shows, the dual slot antenna maintains an acceptable reflection coefficient throughout scan angles of zero to ninety degrees, compared to the single slot antenna which exhibits a much larger reflection coefficient for scan angles below approximately 38 degrees.

Figure 10:
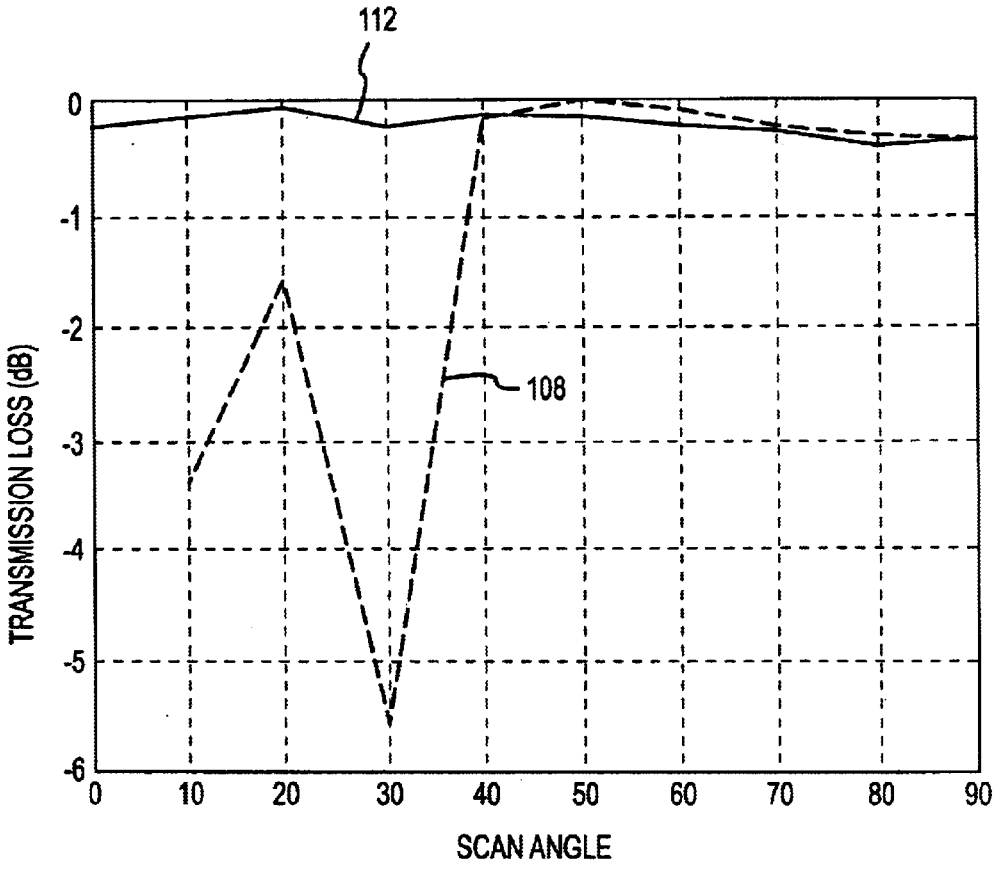
FIG. 10 is a graph illustrating the transmission loss for scan angles of 0°–90° from a dual slot antenna compared to a single slot antenna.

FIG. 10 shows the transmission loss for a single slot antenna, shown by the dashed line 108, and a dual slot antenna, shown by the solid line 112. Transmission loss is a computed quantity which is a function of the magnitude of the reflection coefficient. It is a metric that describes the effective loss of an device caused by the devices inherent mismatch characteristics. Transmission loss is computed by taking 10 $\log_{10}(x)$ where x is the ratio of output power over input power. As FIG. 10 shows, the dual slot antenna maintains a transmission loss of less than 1 dB for scan angles between zero and ninety degrees, while the single slot antenna has significantly greater transmission loss for scan angles below approximately 40 degrees.

Figure 11B:
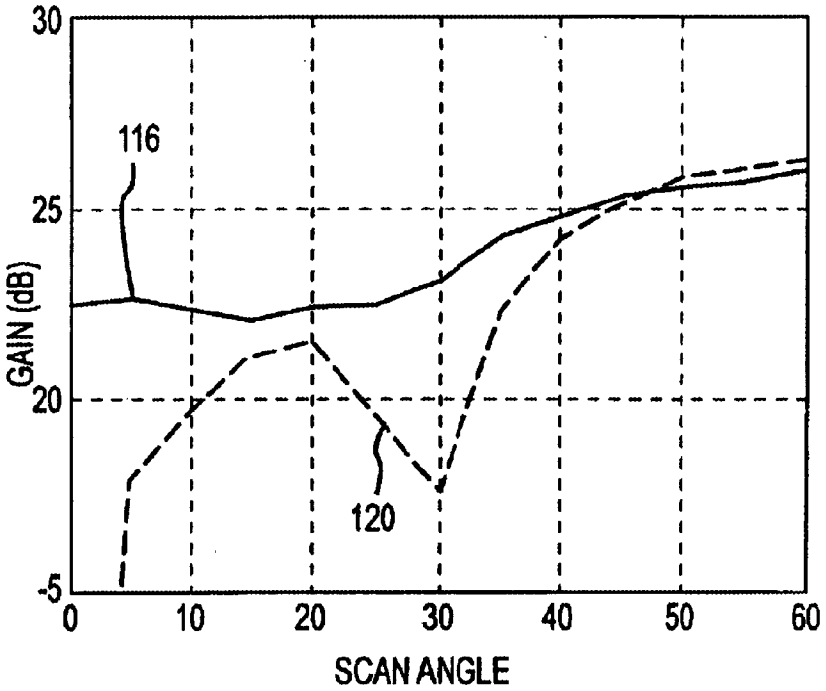
FIG. 11B is an expanded view of FIG. 11A.
Figure 11A:
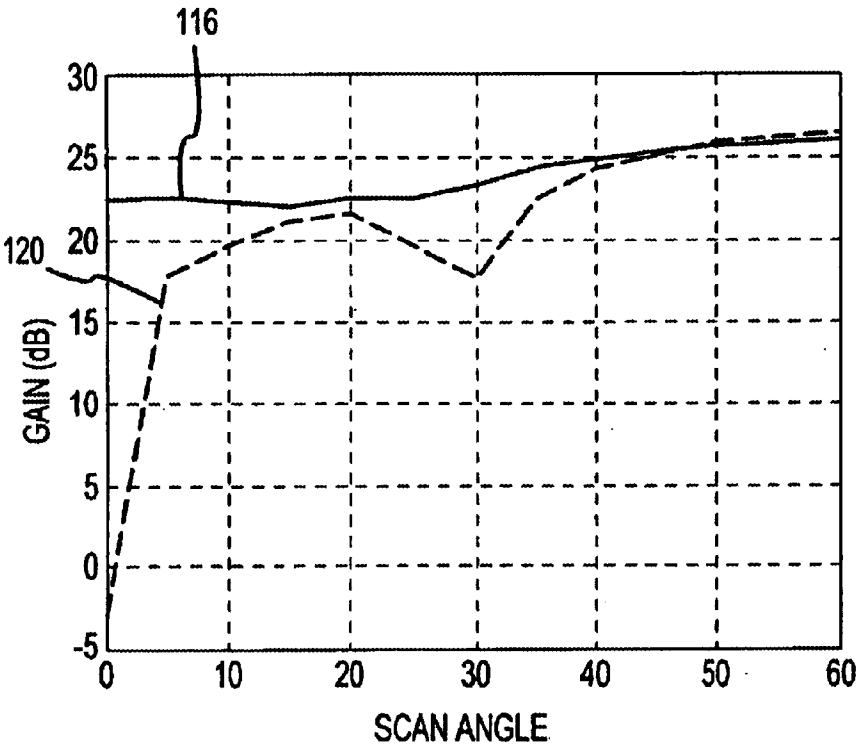
FIG. 11A is a graph illustrating the gain for scan angles of 0°–90° from an array with embedded dual slot antenna compared to an embedded single slot antenna.

FIGS. 11A and 11B show antenna gain which is directivity minus transmission loss due to active impedance mismatch loss. As shown in FIGS. 11A and 11B, the dual slot antenna, as shown by the solid line 116, has relatively stable and acceptable gain through scan angles of zero to ninety degrees, while the single slot antenna, as shown by the dashed line 120, has poor gain at lower scan angles. FIG. 11B shows an expanded scale of FIG. 11A.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, arc within the scope of the present invention. The embodiments described herein above are further intended to explain the best modes presently known of practicing the inventions and to enable others skilled in the art to utilize the inventions in such, or in other embodiments, and with the various modifications required by their particular application or uses of the invention. It is intended that the appended claims be construed to include alternative embodiments to the extent permitted by the prior art.

What is claimed is:

1. An array antenna, comprising:

at least a first row of antenna elements having a first plurality of pairs of antenna elements including at least a first pair and a second pair, said first pair including first and second antenna elements, said second pair including third and fourth antenna elements, said second pair being isolated from said first pair and in which said first and second antenna elements are unisolated from each other and said third and fourth antenna elements are unisolated from each other, wherein a coupling structure couples said first and second antenna elements together, a difference in length of said coupling structure between said first and second antenna elements has a first magnitude and said first magnitude is substantially the same as a first lateral distance between said first and second antenna elements, each of said first, second, third and fourth antenna elements having a longitudinal center axis, each of said first, second, third and fourth antenna elements being laterally spaced from each other in a direction substantially perpendicular to said longitudinal center axes, said first lateral distance being defined between said center longitudinal axes of said first and second antenna elements.

2. An array antenna as claimed in claim 1, wherein second lateral distance being defined between said longitudinal center axes of said second and third antenna elements, wherein said second lateral distance is greater than said first lateral distance.

3. An array antenna as claimed in claim 1, wherein said first and second antenna elements are controlled using a first feed point and said third and fourth antenna elements are controlled using a second feed point.

4. An array antenna as claimed in claim 1, further comprising transmit/receive circuitry electrically connected to said first plurality of pairs of antenna elements that transmits and receives signals relative thereto; and a control system that controls activation/deactivation of said transmit/receive circuitry, said control system for controlling generation of a scanning beam output by at least said first row of antenna elements using said transmit/receive circuitry.

5. An array antenna as claimed in claim 1, wherein a passive beamforming network is used to combine said first plurality of pairs which produces one-to-N beams from 0° to 90°.

6. An array antenna as claimed in claim 1, wherein at least said first and second antenna elements of said first pair are fed with a fixed delay between them based on said difference in length of said coupling structure, said fixed delay being optimized for active impedance of at least said first pair over the full array scan angles.

7. An array antenna, as claimed in claim 6, wherein said fixed delay between said first and second antenna elements is optimized for active impedance over the scan region 0°–90° and the optimized phase is 90°.

8. An array antenna, as claimed in claim 6, wherein said fixed delay between said first and second antenna elements is optimized for active impedance over the scan region, where the scan region can be switched from 0°–90° to 90°–180° by switching the fixed delay from 90° to −90°.

9. An array antenna, as claimed in claim 8, wherein said 90° and −90° fixed delays are produced using a hybrid circuit.

10. An array antenna, as claimed in claim 6, wherein said fixed delay between said first and second elements is optimized for active impedance and is variable dependent upon the array scan angle.

11. An array antenna, as claimed in claim 1, wherein:

a first halfway is defined between said longitudinal center axes of said first and second elements and a second halfway is defined between said longitudinal center axes of said third and fourth antenna elements, and a pair separation distance is defined between said first and second halfways, with said pair separation distances being greater than lambda/two, where lambda equals the wavelength of the center frequency of signals transmitted by the array antenna.

12. An array antenna, as claimed in claim 1, wherein:

said first lateral distance equals about lambda/four.

13. An array antenna, as claimed in claim 1, wherein:

said first and second antenna elements are arranged to be 90° out of phase with one another and have a phase quadrature relationship so that a scanning beam is generated in a first direction and a control pattern null is achieved in a desired direction.

14. An array antenna, as claimed in claim 1, wherein:

said pairs of antenna elements include at least one of the following: slot antenna elements, microstrip patch antenna elements, monopole antenna elements and dipole antenna elements.

15. An array antenna, as claimed in claim 1, wherein:

said first and second antenna elements are slot antenna elements and in which said first and second slot antenna elements are formed in a body member, said first and second slot antenna elements are coupled together using said coupling structure.

16. An array antenna, as claimed in claim 4, wherein:

said transmit/receive circuitry includes at least a first transmit/receive module operably connected to said coupling structure, with said coupling structure having a midpoint and in which said first transmit/receive module is connected to said coupling structure offset from said midpoint thereof.

17. An array antenna, as claimed in claim 4, wherein:

said transmit/receive circuitry includes a plurality of circuit components including a first circuit component and in which said first and second antenna elements are operably connected to said first circuit component.

18. An array antenna, as claimed in claim 4, wherein:

said scanning beam is steerable between at least 0°–90°, where 0° is defined along a plane parallel to said first row of antenna elements and 90° is defined along a plane perpendicular to said first row of antenna elements, wherein said scanning beam produces a resultant reflection coefficient of said antenna array which is significantly less than the reflection coefficient of an identical array produced with single radiators in lieu of pairs of radiators excited with a prescribed phase relationship between radiators at the element pair input with a magnitude of less than 0.5 when said scanning beam is scanning at about 0°.

19. A n array antenna, as claimed in claim 4, wherein:

said scanning beam is steerable between at least 0°–90°, where 0° is defined along a plane parallel to said first row of antenna elements and 90° is defined along a plane perpendicular to said first row of antenna elements, 0° said scanning beam having significantly less loss than an identical array produced with single radiators in lieu of pairs of radiators excited with a prescribed phase relationship between radiators.

20. An array antenna, as claimed in claim 1, further comprising a plurality of rows including said at least first row and in which said plurality of rows are essentially aligned relative to each other to create near a rectangular lattice.

21. An array antenna, as claimed in claim 1, further comprising a plurality of rows including said at least first row and in which said plurality of rows are offset relative to each other in a staggered arrangement.

22. An array antenna, as claimed in claim 21, wherein said staggered arrangement creates a near triangular lattice.

23. An array antenna, as claimed in claim 1, wherein said array antenna is manufactured using machining techniques.

24. An array antenna, as claimed in claim 1, wherein said array antenna is manufactured using casting, investment casting, electroforming, or injection molding techniques.

25. An array antenna, comprising:

a plurality of rows of antenna elements including a first row of a first plurality of pairs of antenna elements including at least a first pair and a second pair, said first pair including first and second antenna elements, said second pair including third and fourth antenna elements, a first halfway being defined between said first and second antenna elements and a second halfway being defined between said third and fourth antenna elements, wherein a first distance is defined between centers of said first and second antenna elements and a pair separation distance is defined between said first and second halfways, and in which said first distance is equal to about lambda/four and said pair separation distance is greater than lambda/four, where lambda equals the wavelength of the center frequency of signals transmitted by the array antenna, wherein a coupling structure couples said first and second antenna elements together, and a difference in length of said coupling structure between said first and second antenna elements is equal to about lambda/four.

26. An array antenna, as claimed in claim 25, further comprising:

transmit/receive circuitry electrically connected to said antenna elements that transmits and receives signals relative thereto; and a control system that controls activation/deactivation of said transmit/receive circuitry.

27. An array antenna, as claimed in claim 25, wherein a passive beamforming network is used to combine said plurality of pairs which produces one-to-N beams from 0° to 90°.

28. An array antenna, as claimed in claim 25, wherein at least said first and second antenna elements of said first pair are fed with a fixed delay between them based on said difference in length of said coupling structure, said fixed delay being optimized for active impedance of said first pair over the full array scan angles.

29. An array antenna, as claimed in claim 28, wherein said fixed delay between said first and second antenna elements is optimized for active impedance over the scan region 0–90° and the optimized phase is 90°.

30. An array antenna, as claimed in claim 28, wherein said fixed delay between said first and second antenna elements is optimized for active impedance over the scan region, where the scan region can be switched from 0°–90° to 90°–180° by switching said fixed delay from 90° to −90°.

31. An array antenna, as claimed in claim 30, wherein the 90° and −90° fixed delays are produced using a hybrid circuit.

32. An array antenna, as claimed in claim 28, wherein said fixed delay between said first and second antenna elements is optimized for active impedance and is variable dependent upon the array scan angle.

33. An array antenna, as claimed in claim 25, wherein:

said first and second antenna elements are spaced 90° apart and are physically arranged to be 180° out of phase with one another and simultaneously in a phase quadrature relationship to achieve an endfire beam in one direction and a control pattern null in a desired direction.

34. An array antenna, as claimed in claim 26, wherein:

said first and second antenna elements are slot antenna elements operatively joined together using coupling structure having a midpoint and in which said transmit/receive circuitry is operably connected to said coupling structure offset from said midpoint thereof.

35. An array antenna, as claimed in claim 34, wherein:

said first antenna slot, said second antenna slot and said coupling structure are formed in a body member.

36. An array antenna, as claimed in claim 25, wherein said plurality of rows are essentially aligned relative to each other to create near a rectangular lattice.

37. An array antenna as claimed in claim 25, wherein said plurality of rows are offset relative to each other in a staggered arrangement.

38. An array antenna, as claimed in claim 37, wherein the staggered arrangement creates a near triangular lattice.

39. An array antenna, as claimed in claim 25, wherein said array antenna is manufactured using machining techniques.

40. An array antenna, as claimed in claim 25, wherein said array antenna is manufactured using casting, investment casting, electroforming, or injection molding techniques.

41. A method for generating a scanning beam, comprising:

providing a plurality of rows of antenna elements including a first row comprising a first plurality of pairs of antenna elements including at least a first pair and a second pair, said first pair including first and second antenna elements and said second pair including third and fourth antenna elements, wherein a coupling structure couples said first and second antenna elements together; and generating a scanning beam using said plurality of antenna elements including said first and second antenna elements and, during said generating step, when said scanning beam is at about 0°, where 0° is defined along a plane parallel to said plurality of antenna elements, maintaining a reflection coefficient associated with said first and second antenna elements less than 0.5, wherein a signal offset between said first and second antenna elements exists during said generating and said signal offset is based on a difference in length of said coupling structure between said first and second antenna elements, said difference in length being substantially equal to a lateral distance between said first and second antenna elements.

42. A method, as claimed in claim 41, wherein:

said maintaining step includes maintaining a transmission loss associated with said first and second antenna elements to be less than −1 db when said beam is scanning at about 0°.

43. A method, as claimed in claim 41, wherein:

said first and second antenna elements are spaced 90° apart, and said providing step includes arranging said first and second antenna elements to be 180° out of phase with one another and simultaneously in a phase quadrature relationship in order to achieve an endfire beam in one direction and a controlled pattern null in a desired direction.

44. A method, as claimed in claim 41, where the plurality of rows are essentially aligned relative to each other to create near a rectangular lattice.

45. A method, as claimed in claim 41, wherein said plurality of rows are offset relative to each other in a staggered arrangement.

46. A method, as claimed in claim 45, wherein said staggered arrangement creates a near triangular lattice.

47. A method, as claimed in claim 41, wherein said antenna elements are manufactured using machining technique.

48. A method, as claimed in claim 41, wherein said antenna elements are manufactured using casting, investment casting, electroforming, or injection molding techniques.

* * * * *